United States Patent [19]

Anderson

[11] Patent Number: 4,600,249

[45] Date of Patent: Jul. 15, 1986

[54] COMPUTER SECURITY CABINET

[75] Inventor: Terry W. Anderson, Brookfield, Wis.

[73] Assignee: Omni Tech Corporation, Brookfield, Wis.

[21] Appl. No.: 663,779

[22] Filed: Oct. 23, 1984

[51] Int. Cl.[4] ..... A47B 37/02; A47B 81/06

[52] U.S. Cl. ..... 312/196; 312/7.2; 312/208; 312/236; 108/27; 108/50

[58] Field of Search ..... 312/196, 194, 7.1, 7.2, 312/208, 327, 323, 236, 351, 119; 108/27, 50; 364/708

[56] References Cited

U.S. PATENT DOCUMENTS

| | | | |
|---|---|---|---|
| 1,314,628 | 9/1919 | Willman | 312/208 |
| 3,541,256 | 11/1970 | Anders | 312/196 |
| 3,622,700 | 11/1971 | Goetz, Jr. | 312/7.2 |
| 3,664,616 | 5/1972 | Raskin . | |
| 3,715,148 | 2/1973 | Beals | 312/209 |
| 3,827,772 | 8/1974 | Johnson | 312/7.1 |
| 3,850,392 | 11/1974 | Gassaway . | |
| 3,887,057 | 6/1975 | Stahl et al. | 312/208 |
| 3,910,079 | 10/1975 | Gassaway . | |
| 4,022,036 | 5/1977 | Cebuhar . | |
| 4,250,955 | 2/1981 | Plattner et al. | 312/236 |
| 4,305,563 | 12/1981 | Presson . | |
| 4,307,923 | 12/1981 | Raz | 312/209 |
| 4,313,112 | 1/1982 | Foster . | |
| 4,483,572 | 11/1984 | Story | 312/7.2 |
| 4,493,267 | 1/1985 | Jedziniak | 312/236 |
| 4,496,200 | 1/1985 | Hagstrom et al. | 312/208 |

FOREIGN PATENT DOCUMENTS

| | | | |
|---|---|---|---|
| 3132015 | 10/1982 | Fed. Rep. of Germany | 108/27 |

OTHER PUBLICATIONS

Advertising brochure entitled "You've Got a Lot to Lose", distributed by Standard Duplicating Machines Corp.

Advertisement brochure entitled "Protect and Organize!" distributed by FMJ Inc.

Advertisement brochure entitled "Exciting Products from Moore!" distributed by Moore Computer Supplies & Forms.

Advertisement brochure entitled "A Way to Hold Your Typewriter" distributed by Equipment Environments.

Advertisement brochure entitled "Protecting Your Apple . . . an Open and Shut Case" distributed by Doss Industries.

Advertisement brochure entitled "Apple Crate" distributed by Rham Ltd.

Advertisement entitled "Stop Apple Theft" distributed by Seagull Enterprises.

Advertisement brochure entitled "Protect Your Computer from Theft or Damage" distributed by Tec-Mart, Inc.

Advertisement brochure entitled "Apple II Support System" distributed by Trace Systems, Inc.

*Primary Examiner*—Victor N. Sakran

*Attorney, Agent, or Firm*—Andrus, Sceales, Starke & Sawall

[57] ABSTRACT

A security cabinet for protecting components of a microcomputer at a work station. The security cabinet includes a hollow housing having an open front permitting access to the interior of the housing, a shelf slidably mounted within the housing, a door pivotally mounted on the housing between an open position permitting sliding movement of the shelf and a closed position enclosing a portion of the open front to prevent movement of the shelf and removal of components from the housing, and a lock on the door for locking the door in its closed position to the shelf. The shelf accommodates single or dual disc drives and when slid into the housing defines a storage space behind the disc drives and prevents the removal of a cooling fan from the computer. A monitor may be fastened to the top of the housing, and the door may be opened without removing the monitor. The door also includes bent flanges on its opposite sides that overlap the front edges of the housing, and an elongate opening dimensioned to permit access to the disc drives when closed but to prevent removal of the disc drives. Hinged wing flaps are mounted on the front edges of the side walls of the housing to hold the shelf in position when the door is closed and locked. The cabinet is bolted to a work surface utilizing distressed thread nuts which cannot be removed without having access to the cabinet interior.

12 Claims, 5 Drawing Figures

COMPUTER SECURITY CABINET

BACKGROUND OF THE INVENTION

The present invention relates to security devices, and more particularly to a security cabinet for protecting the components of microcomputers at a work station.

Microcomputers having a cathode ray tube display screen monitor, disk drives and a keyboard connectable to a central processing unit are widely used in various industries. In the conventional assembly, the display monitor is positioned immediately above the central processing unit and to the rear of the keyboard. A common practice is to locate the display monitor, disk drives, central processing unit and keyboard on a horizontal surface at a work station such as a desk. Such an arrangement, however, does not provide any security for the microcomputer. Thus, it is desirable to provide a device that deters theft, tampering and unauthorized use of microcomputers.

Several types of structures are known for supporting the components of a microcomputer at a work station. For example, U.S. Pat. No. 4,305,563 shows an assembly having a rotatable base for supporting the display monitor and a carriage slidably attached to the base for supporting the keyboard. Another type of assembly is shown in U.S. Pat. No. 4,313,112. This assembly provides a structure for supporting the keyboard and display monitor in line with one another centrally on top of a desk. Neither of the above assemblies, however, provide any protection against theft, tampering or unauthorized use of a microcomputer.

Numerous products are also known for providing a secure arrangement for microcomputers. For example, security cabinets that provide sliding drawers for the keyboard and hinged covers that lock the keyboard, central processing unit and disc drives together are known. These devices, however, suffer from lack of versatility in that the known security cabinets are designed to accommodate only one or very limited number of microcomputer designs. It is therefore desirable to provide a security cabinet that not only protects the components of a microcomputer terminal, but has features which are compatible with all types of microcomputer designs.

Examples of various types of security devices for protecting office equipment such as typewriters, calculators and the like can be found in the following patents:

| U.S. Pat. No. | Inventor | Issue Date |
|---|---|---|
| 4,022,036 | Cebuhar | May 10, 1977 |
| 3,910,079 | Gassaway | Oct. 7, 1975 |
| 3,850,392 | Gassaway | Nov. 26, 1974 |
| 3,664,616 | Raskin | May 23, 1972 |

SUMMARY OF THE INVENTION

A security cabinet for protecting components of a microcomputer at a work station. The features provided herein can be used to accommodate numerous types of microcomputer designs, and deter theft, tampering, and unauthorized use of the microcomputer. The cabinet may be anchored securely to the surface on which it is supported, and locks up all the components of a microcomputer except a printer. The security cabinet permits the microcomputer to be totally usable even in its locked position, and also permits easy access to all components for repair and/or adjustment.

The security cabinet includes a hollow housing having an open front permitting access to the interior of a component-receiving cavity, a shelf mounted on the housing within the cavity, a door pivotally mounted on the housing to enclose at least a portion of the open front, and lock means on the door for locking the door in its closed position to the shelf.

The housing includes opposite side walls interconnected by a top and rear wall. The side walls include legs for mounting the cabinet to its supporting surface, and the top wall includes a plurality of slots for mounting a display monitor thereon. One of the side walls also includes an opening therein for accommodating a computer component such as a cooling fan projecting therethrough. The rear wall also includes an opening therein for receiving a power cord therethrough.

The door is pivotally mounted to the housing between an open position permitting components and a closed position preventing removal of components from the cavity. The door is positioned so that it is unnecessary to move the monitor in order to open the door and gain access to the components within the housing. The door includes bent flanges on its opposite side edges that overlap the front edges of the side walls of the housing, and may also include an elongate opening dimensioned to permit use of a component such as a disc drive supported on the shelf within the housing when closed but to prevent removal of the component therefrom.

The shelf includes a rear edge spaced from the rear wall of the housing to define a storage area for power cords and the like therebetween. The shelf also includes a stop flange projecting upwardly from the rear edge for properly locating a component. The shelf may also be slidably movable within the housing so that in its inner position it prevents removal of a computer component such as a cooling fan through the opening in the side wall of the housing, but in its outer position permits the removal of this component.

The slide mounting for the shelf includes a bracket on each side wall of the housing that defines a first sliding surface and a channel member on each side of the shelf that defines a second sliding surface in sliding engagement with the bracket. Each channel includes an outer leg which is slidably received within a groove formed by a guide member projecting from the side wall of the housing. A pair of hinged wing flaps are pivotally mounted to the front edges of each side wall of the housing for holding the shelf in position.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
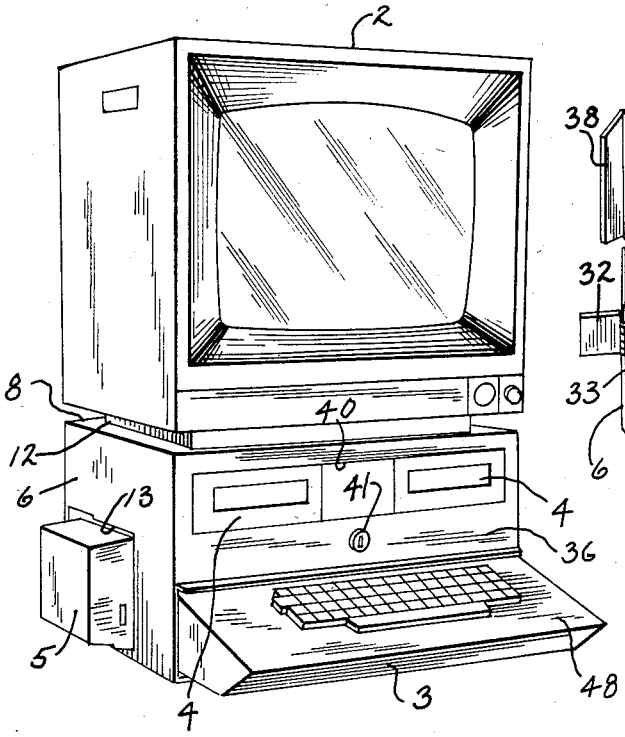
FIG. 1 is a perspective front view in elevation of a microcomputer incorporating a security cabinet constructed in accordance with the principles of the present invention.
Figure 2:
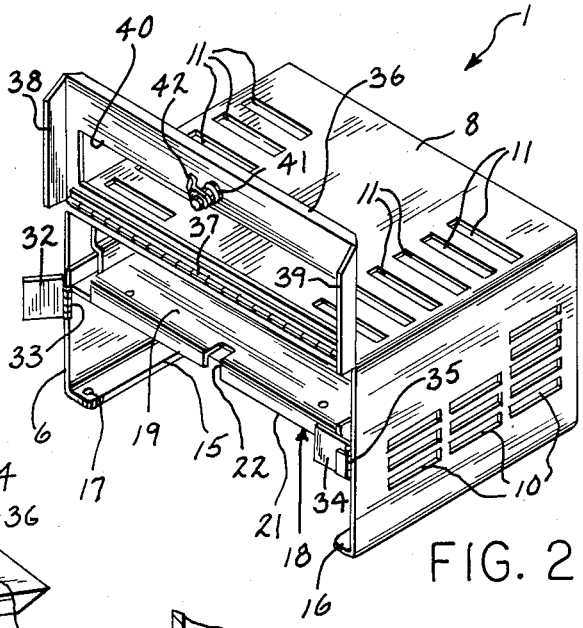
FIG. 2 is a front perspective view of the security cabinet shown in FIG. 1 with the microcomputer components removed.

Referring now to the drawings, FIGS. 1 and 2 illustrate a microcomputer incorporating a security cabinet generally designated by the numeral 1 constructed in accordance with the principles of the present invention. The microcomputer illustrated includes a cathode ray tube display screen monitor 2, keyboard and central processing unit 3, a pair of disc drives 4 and a cooling fan 5. The microcomputer is illustrated as being at a work station such as a desk 43 of typical construction defining a horizontal work surface 44 for supporting the microcomputer. The work station may also be any type of table or portable cart upon which a microcomputer might be supported. Also, although illustrated as being for the purpose of protecting components of a microcomputer, cabinet 1 may be employed to secure various other components typically used in an office environment.

Figure 3:
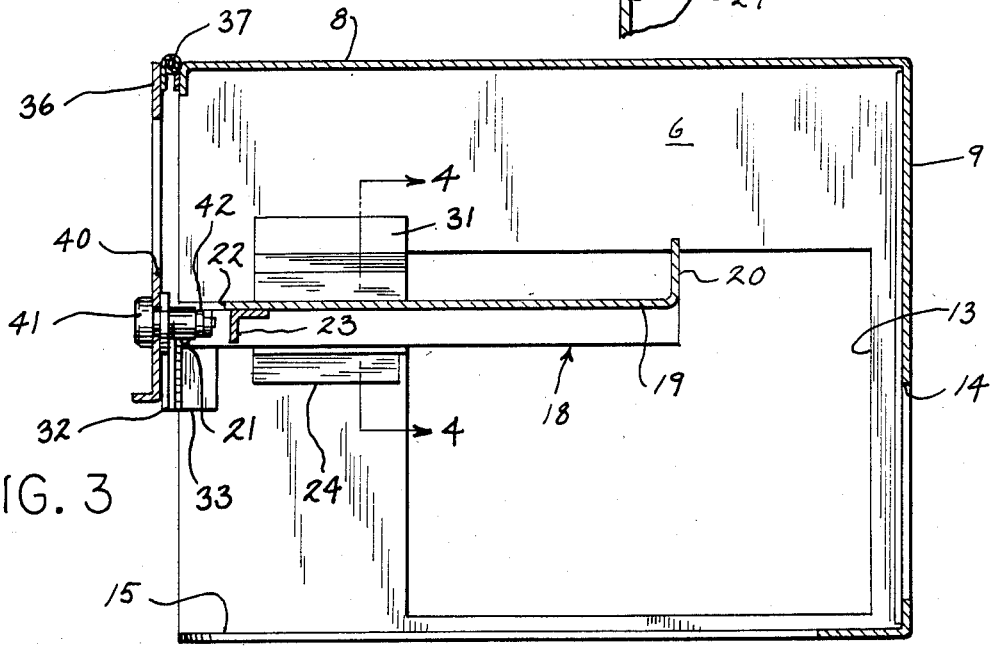
FIG. 3 is a cross sectional side view in elevation of the security cabinet of FIG. 2.

Cabinet 1 includes a hollow housing having a pair of opposite side walls 6 and 7 interconnected by a top wall 8 and rear wall 9. Walls 6–9 define a component-receiving cavity having an open front and bottom permitting access to the cavity. As shown best in FIG. 2, side wall 7 includes a plurality of slots 10 formed therethrough which provide ventilation for the computer components within cabinet 1. Top wall 8 also includes a plurality of mounting slots 11 formed therethrough adjacent each side edge thereof. Slots 11 provide a convenient means for fastening monitor 2 to top wall 8. This may be accomplished by inserting screws from within cabinet 1 through slots 11 and into base 12 of monitor 2. Monitor 2 is thus fastened on cabinet 1 at a convenient viewing height in a stable and secure manner. As shown best in FIG. 3, side wall 6 includes a rectangular opening 13 through which cooling fan 5 projects. Rear wall 9 includes an elongate rectangular opening 14 formed therethrough at its lower end for accommodating power cords between the keyboard and central processing unit 3 and monitor 2 as well as between unit 3 and a main electrical outlet. Elongate opening 14 may also accommodate other devices such as a printer interface data cable. Rear wall 9 may also include ventilation slots similar to slots 10 above opening 14 if desired. Side walls 6 and 7 also include mounting legs 15 and 16 respectively at their lower edges each having a pair of bolt holes 17 formed therethrough.

Figure 5:
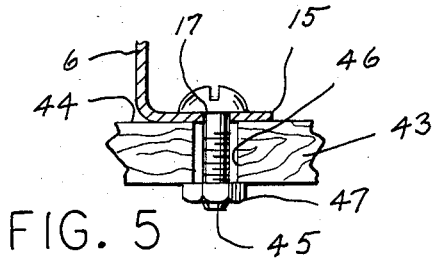
FIG. 5 is a fragmentary cross sectional view illustrating one leg of the cabinet anchored to a surface.

Mounting legs 15 and 16 are employed to securely fasten cabinet 1 to work surface 44 desk 43. As shown best in FIG. 5, bolts 45 pass through holes 17 in legs 15 and 16 and then through hole 46 in desk 43. A distressed thread nut 47 is then brought up tight against the undersurface of desk 43. Any excess length of bolts 45 projecting from nuts 47 should be removed with a bolt cutter. As illustrated, the diameters of holes 46 are greater than the diameter of the shanks of bolts 45 so that nuts 47 due to their distressed threads cannot be removed from the shanks of bolts 45 without having access to the interior of cabinet 1 so that the heads of bolts 45 may be prevented from turning with nuts 47. Cabinet 1 as well as the components therein are thus securely fastened at a work station to deter theft.

Cabinet 1 also includes a shelf 18 slidably mounted therein on side walls 6 and 7. Shelf 18 may be moved between an inner position within cabinet 1, as shown in FIG. 2, and an outer position projecting from the open front of cabinet 1. Shelf 18 divides the inner component-receiving cavity of cabinet 1 into upper and lower component-receiving chambers. Shelf 18 includes a flat plate 19 defining a supporting surface for disc drives 4. Plate 19 includes a rear edge having a stop flange 20 projecting upwardly therefrom. Stop flange 20 is spaced from rear wall 9 to define a storage area therebetween for components such as power cords and the like. The front edge of plate 19 includes a depending flange 21 having a slot 22 formed centrally therein. An L-shaped bracket 23 is positioned adjacent to and behind slot 22 on the undersurface of plate 19.

Figure 4:
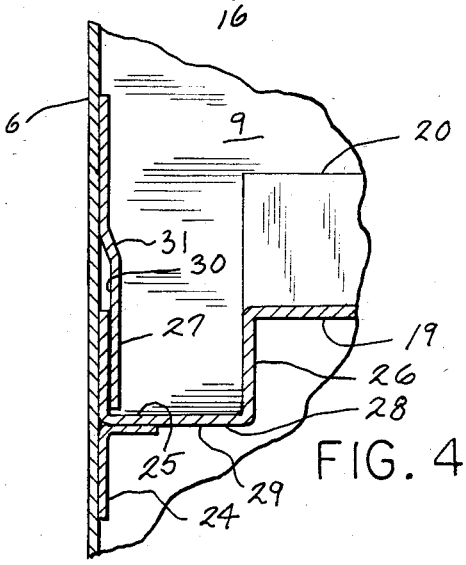
FIG. 4 is a fragmentary cross sectional view taken along the plane of the line 4—4 in FIG. 3.

Referring now to FIG. 4, the slide mounting of shelf 18 is provided by a pair of slide assemblies on each side of shelf 18. Since both slide assemblies are identical in structure, only one will hereinafter be described. The slide mounting includes an L-shaped bracket 24 on side wall 6 defining a first sliding surface 25 thereon. Shelf 18 includes a channel-shaped member at its side edge having an inner leg 26, an outer leg 27 and an interconnecting web 28. The undersurface of web 28 defines a second sliding surface 29 in sliding engagement with sliding surface 25 of bracket 24. Legs 26 and 27 extend parallel to side wall 6, and leg 27 is received within a channel-receiving groove 30 formed by a guide member 31. As shown, guide member 31 includes an upper portion affixed to the inner surface of side wall 6 and a lower portion disposed parallel to side wall 6 and spaced therefrom to define groove 30. Outer leg 27 is thus captured within groove 30.

A pivotable wing flap 32 is located on the front edge of side wall 6. The pivot connection of the flap 32 is provided by a hinge which is mounted to the inside surface of side wall 6 immediately beneath shelf 18. A second wing flap 34 is pivotally mounted on the front edge of side wall 7 by a hinge 35 in a manner similar to wing flap 32. Wing flaps 32 and 34 function to locate and hold shelf 18 in its inner position when door 36 is locked to shelf 18.

As seen best in FIG. 4, when shelf 18 is slid inwardly to its inner position it prevents the removal of cooling fan 5 through opening 13 by interfering with the normal procedure for removing fan 5. In other words, fan 5 is normally attached to the central processing unit 3 by inserting it through opening 13 and lowering it into ventilation slots formed in the side of central processing unit 3. Thus, when shelf 18 is moved to its inner position it interferes with a user's ability to remove cooling fan 5 since cooling fan 5 cannot be raised sufficiently to disengage it from the ventilation slots on the central processing unit 3. Thus, fan 5 is locked in position and can only be removed when shelf 18 is moved to its outer position projecting from the front of cabinet 1.

Cabinet 1 also includes a flip-up door 36 pivotally mounted by a locked pin piano hinge 37 to the front edge of top wall 8. Door 36 is movable between an open position permitting sliding movement of shelf 18, and a closed position wherein it encloses a portion of the open front of cabinet 1 to prevent movement of shelf 18 and removal of disc drives 4 and central processing unit 3 by locking or engaging against front angular face 48 of unit 3. Door 36 includes a pair of bent flanges 38 and 39 disposed on opposite side edges thereof that overlap the front edges of side walls 6 and 7. Bent flanges 38 and 39 prevent the insertion of a tool such as screwdriver between door 36 and side walls 6 and 7 so that a person cannot "jimmy" the lock. Door 36 also includes an elongate rectangular opening 40 formed therethrough which is dimensioned to permit use of disc drives 4 on shelf 18 when closed but to prevent removal of disc drives 4 therefrom. Door 36 also includes a key lock 41 mounted thereon which includes a rotatable lock member 42 that may be pivoted between locked and unlocked positions by turning a key in lock 41. In order to lock door 36 to shelf 18, lock member 42 is turned downwardly to a position 90° from that shown in FIG. 2 so that it may pass through slot 22. Lock member 42 may then be turned to the position shown in FIGS. 2 and 3 whereby member 42 is positioned behind front flange 21 of shelf 18 thus preventing the opening of door 36. As shown by FIG. 2, door 36 may be opened without removing monitor 2 from top wall 8.

In order to lock the main power cord (not shown) within cabinet 1, door 36 is opened and the end of the power cord is placed under shelf 18 and above keyboard and central processing unit 3 with the cord projecting out under one of the wing flaps 32 or 34. Door 36 is then closed and locked.

A security cabinet for protecting components of a microcomputer at a work station has been illustrated and described. Various modifications and/or substitutions of the specific components described herein may be made without departing from the scope of the invention. For example, door 36 may be hinged at the bottom of side walls 6 and 7 to open downwardly instead of upwardly and become a shelf for the keyboard when in use. Also, shelf 18 need not necessarily be slidably mounted within cabinet 1, but instead may be rigidly mounted therein, and it need not include plate 19, but instead may be composed of angled brackets positioned to slidably receive specific microcomputer components.

Various modes of carrying out the invention are contemplated as being within the scope of the following claims particularly pointing out and distinctly claiming the subject matter which is regarded as the invention.

I claim:

1. A security cabinet for protecting components of a microcomputer at a work station, comprising:

a hollow housing defining a component-receiving cavity, said housing having an open front permitting access to said cavity;

a shelf mounted on said housing within said cavity, said shelf dividing said cavity into upper and lower component-receiving chambers, said shelf is slidably mounted between an inner position within said cavity and outer position projecting from the open front of said housing;

said housing includes a side wall and the slide mounting of said shelf includes a bracket on said side wall defining a first sliding surface thereon, and said shelf includes a corresponding second sliding surface in sliding engagement with said first sliding surface, said shelf includes a channel member running the length of its side that includes said second sliding surface, and said channel member includes an outer leg extending parallel to said side wall, and said side wall includes a guide member defining a channel-receiving groove that slidably receives said outer leg;

a door pivotally mounted on said housing between an open position and a closed position enclosing at least a portion of said open front to prevent removal of components from said cavity and prevent movement of said shelf in said closed position; and lock means on said door for locking said door in its closed position to said shelf.

2. The security cabinet of claim 1, wherein said housing includes mounting means for mounting a display monitor thereon.

3. The security cabinet of claim 2, wherein said housing includes a top wall and said mounting means includes a plurality of openings formed in said top wall.

4. The security cabinet of claim 1, wherein said housing includes a pair of opposite side walls each having a front edge, and said door includes bent flanges on opposite side edges thereof that overlap the front edges of said side walls.

5. The security cabinet of claim 4, wherein said door further includes an elongate opening formed therein dimensioned to permit use of a component in said upper chamber when closed but to prevent removal of said component therefrom.

6. The security cabinet of claim 1, wherein said housing includes a rear wall and said shelf includes a rear edge spaced from said rear wall to define a storage area therebetween for cords and the like.

7. The security cabinet of claim 6, wherein said shelf includes a stop flange projecting upwardly from said rear edge.

8. A security cabinet for protecting components of a microcomputer at a work station, comprising:

a hollow housing having a pair of opposite side walls each with front edges and interconnected by a top and rear wall, said walls defining a component-receiving cavity having an open front permitting access to said cavity, one of said side walls having an opening therein for receiving a computer component projecting therethrough, and said rear wall includes an opening therein for receiving a power cord therethrough;

a shelf slidably mounted on the side walls of said housing between an inner position within said cavity and an outer position projecting from the open front of said housing, said shelf dividing said cavity into upper and lower component-receiving chambers and includes a rear edge having an upwardly projecting stop flange spaced from said rear wall to define a storage area therebetween, said shelf being positioned so that in said inner position it prevents the removal of said computer component and in said outer position it permits the removal of said computer component through said opening, wherein the slide mounting of said shelf includes a bracket on each of said side walls defining first sliding surfaces thereon, and said shelf includes a channel member running the length of each of its sides that includes second sliding surfaces in sliding engagement with said first sliding surfaces;

a door pivotally mounted on said housing between an open position permitting sliding movement of said shelf and a closed position enclosing at least a portion of said open front to prevent movement of said shelf and removal of components from said cavity, said door includes bent flanges on opposite side edges thereof that overlap the front edges of said side walls and an elongate opening formed therein dimensioned to permit use of a component in said upper chamber when closed but to prevent removal of said component therefrom; and lock means on said door for locking said door in its closed position to said shelf.

9. The security cabinet of claim 8, wherein the slide mounting of said shelf includes a bracket on each of said side walls defining first sliding surfaces thereon, and said shelf includes a channel member running the length of each of its sides that includes second sliding surfaces in sliding engagement with said first sliding surfaces.

10. The security cabinet of claim 8, wherein each of said channel members includes an outer leg extending parallel to said side wall, and each of said side walls includes a guide member defining a channel-receiving groove that slidably receives said outer leg.

11. A security cabinet for protecting components of a microcomputer at a work station, comprising:

a hollow housing having a pair of opposite side walls each with front edges and interconnected by a top and rear wall, said walls defining a component-receiving cavity having an open front permitting access to said cavity;

a shelf mounted on the side walls of said housing, said shelf divides said cavity into upper and lower component-receiving chambers and includes a front edge having a depending flange projecting downwardly therefrom and extending between said side walls with a slot formed in said flange intermediate its ends;

a door pivotally mounted on said housing between an open position and a closed position enclosing at least a portion of said open front to prevent removal of components from said cavity, said door includes bent flanges on opposite side edges thereof that overlap the front edges of said side walls;

lock means on said door for locking said door in its closed position to said shelf, said lock means includes a rotatable lock member pivotable between an unlocked position wherein said lock member is aligned with the slot in said depending flange of said shelf to permit opening of said door and a locked position wherein said lock member is turned to a position behind said depending flange of said shelf to prevent opening of said door; and stiffening means adjacent the slot in said depending flange of said shelf for reinforcing said shelf at the location of said slot.

12. The security cabinet of claim 11, wherein said stiffening means includes a bracket positioned behind said slot on the undersurface of said shelf.

* * * * *